US010527971B2

(12) United States Patent
Nakamura et al.

(10) Patent No.: US 10,527,971 B2
(45) Date of Patent: Jan. 7, 2020

(54) DEVELOPING APPARATUS AND PROCESS CARTRIDGE

(71) Applicant: CANON KABUSHIKI KAISHA, Tokyo (JP)

(72) Inventors: Yuuki Nakamura, Mishima (JP); Tsukasa Abe, Yokohama (JP); Tatsuro Harada, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/292,867

(22) Filed: Mar. 5, 2019

(65) Prior Publication Data

US 2019/0278200 A1 Sep. 12, 2019

(30) Foreign Application Priority Data

Mar. 9, 2018 (JP) ..... 2018-043243

(51) Int. Cl.
*G03G 15/08* (2006.01)
*G03G 21/18* (2006.01)

(52) U.S. Cl.
CPC ..... *G03G 15/0891* (2013.01); *G03G 21/1814* (2013.01)

(58) Field of Classification Search
CPC ..... G03G 15/0891; G03G 21/1814
See application file for complete search history.

(56) References Cited

U.S. PATENT DOCUMENTS

| | | | | |
|---|---|---|---|---|
| 7,885,583 | B2 * | 2/2011 | Shigehiro | G03G 15/0896 399/222 |
| 2014/0056621 | A1 * | 2/2014 | Hashimoto | G03G 15/0867 399/254 |
| 2015/0227083 | A1 * | 8/2015 | Matsukawa | G03G 15/0808 399/111 |
| 2016/0252848 | A1 * | 9/2016 | Abe | G03G 15/0891 399/254 |
| 2019/0101849 | A1 * | 4/2019 | Maeshima | G03G 15/0887 |

FOREIGN PATENT DOCUMENTS

| | | | |
|---|---|---|---|
| JP | 2006276615 | A | 10/2006 |
| JP | 2011099894 | A | 5/2011 |
| JP | 2011253203 | A | 12/2011 |
| JP | 2013246403 | A | 12/2013 |
| JP | 2013250298 | A | 12/2013 |
| JP | 2014044326 | A | 3/2014 |
| JP | 2016161714 | A | 9/2016 |
| JP | 2016206273 | A | 12/2016 |
| JP | 2018017972 | A | 2/2018 |
| JP | 2018063282 | A | 4/2018 |

* cited by examiner

*Primary Examiner* — G. M. A Hyder
(74) *Attorney, Agent, or Firm* — Canon U.S.A., Inc. IP Division

(57) ABSTRACT

A developing apparatus includes a first conveying member and a second conveying member shorter than the first conveying member. In a rotational direction of the rotation shaft, the second conveying member is disposed upstream of the first conveying member, with the fixed end of the second conveying member and the fixed end of the first conveying member placed one on another. The free length of the second conveying member at a first position, a second position, and a third position, which sequentially distance away from the driving transmission member in the axial direction of the rotation shaft, sequentially becomes larger.

18 Claims, 10 Drawing Sheets

DEVELOPING APPARATUS AND PROCESS CARTRIDGE

BACKGROUND OF THE DISCLOSURE

Field of the Disclosure

The present disclosure relates to developing apparatuses and process cartridges. In particular, the present disclosure relates to a developing apparatus or a process cartridge that is detachably mounted to an electrophotographic image forming apparatus.

Description of the Related Art

Electrophotographic image forming apparatuses generally have a configuration in which various functional members are integrated into one unit or cartridge to facilitate maintenance. In particular, developing units that implement a developing function include functional members such as a developer carrying member that carries a developer and a conveying member that conveys the developer to the developer carrying member.

For example, Japanese Patent Laid-Open No. 2011-253203 (Patent Literature 1) proposes a developing unit including a conveying member that stirs and conveys a developer in a developer container. Specifically, a flexible sheet is attached to the rotating shaft of the conveying member that stirs and conveys the developer with the rotational operation. The developer in the developer container is conveyed to a developing chamber by a restoring three due to the elastic deformation of the flexible sheet.

Japanese Patent Laid-Open No. 2011-99894 (Patent Literature 2) proposes a method for varying, in the longitudinal direction of the sheet, the length of the sheet in the direction perpendicular to the longitudinal direction to reduce the load of the conveying member during the rotational operation.

Japanese Patent Laid-Open No. 2016-161714 (Patent Literature 3) proposes a configuration in which a plurality of sheets are put in layers so as to increase the toner conveying capacity of the sheet. Japanese Patent Laid-Open No. 2013-250298 (Patent Literature 4) proposes a configuration in which a metal member (a leaf spring) is disposed on the back of the sheet so as to increase the toner conveying capacity of the sheet.

In any of the configurations of Patent Literatures 1 to 4, the toner is conveyed by a flexible sheet attached to the toner conveyance shaft, and the toner conveyance shaft is rotationally driven by receiving a driving force from the main body via a drive transmission unit attached to one end (one side) of the toner conveyance shaft in the longitudinal direction.

However, in the known configurations described above, since the toner conveyance shaft is rotationally driven at only one side, the toner conveyance shaft can be twisted and deformed along the axial direction due to the load (resistance) of the toner in the developer container. In particular, such a phenomenon is more noticeably seen in the case where the toner conveyance shaft is made of an elastic material.

Due to the influence of the twisting and deforming phenomenon of the toner conveyance shaft, the timing at which the sheet attached to the conveyance shaft reaches a restoration position where the elastic deformation is released to generate a returning three can differ in the longitudinal direction.

Specifically, the driving side of the sheet driven by the driving transmission member (at which the driving transmission member is present) rotates first to reach the restoration position and is released. At this timing, the non-driving side of the sheet (the side opposite to the driving side) has not yet reached the restoration position. The non-driving side reaches the restoration position and is released at a position where the driving side further rotates (that is, a little late timing).

Such a difference in release timing between the driving side and the non-driving side tends to cause the amount of the developer held on the upper surface of the sheet non-uniform in the longitudinal direction. This can also make the amount of the developer conveyed to the developing chamber non-uniform in the longitudinal direction.

SUMMARY OF THE INVENTION

The present disclosure provides a developing apparatus and a process cartridge that allows the amount of toner conveyed from a developer container to a developing chamber to be more uniform in the longitudinal direction.

A developing apparatus according to a first aspect of the present disclosure includes a developer container configured to contain a developer, a rotation shaft, a driving transmission member, a first conveying member, and a second conveying member. The rotation shaft is disposed in the developer container and is rotatable along a predetermined rotational direction. The driving transmission member is connected to one end of the rotation shaft in an axial direction and is configured to transmit an external driving force to the rotation shaft to rotate the rotation shaft. The first conveying member is mounted to the rotation shaft, with one end being fixed as a fixed end to the rotation shaft and another end being free as a free end in a direction perpendicular to the axial direction of the rotation shaft. The second conveying member is mounted to the rotation shaft, with one end being fixed as a fixed end to the rotation shaft and another end being free as a free end in the direction perpendicular to the axial direction of the rotation shaft. A free length from the fixed end to the free end of the second conveying member is smaller than that of the first conveying member. In a rotational direction of the rotation shaft, the second conveying member is disposed upstream of the first conveying member, with the fixed end of the second conveying member and the fixed end of the first conveying member placed one on another. The free length of the second conveying member at a first position, a second position, and a third position, which sequentially distance away from the driving transmission member in the axial direction of the rotation shaft, sequentially becomes larger.

A developing apparatus according to a second aspect of the present disclosure includes a developer container configured to contain a developer, a rotation shaft, a driving transmission member, a first conveying member, and a second conveying member. The rotation shaft is disposed in the developer container and is rotatable along a predetermined rotational direction. The driving transmission member is connected to one end of the rotation shaft in an axial direction and is configured to transmit an external driving force to the rotation shaft to rotate the rotation shaft. The first conveying member is mounted to the rotation shaft, with one end being fixed as a fixed end to the rotation shaft and another end being free as a free end in a direction perpendicular to the axial direction of the rotation shaft. The second conveying member is mounted to the rotation shaft, with one end being fixed as a fixed end to the rotation shaft and another end being free as a free end in the direction perpendicular to the axial direction of the rotation shaft. A free length from the fixed end to the free end of the second convey member is smaller than that of the first conveying member. In a rotational direction of the rotation shaft, the second conveying member is disposed upstream of the first conveying member, with the fixed end of the second conveying member and the fixed end of the first conveying member placed one on another. The free length of the second conveying member at a position farthest away from the driving transmission member in the axial direction of the rotation shaft, is larger than that at a position nearest to the driving transmission member.

A process cartridge according to a third aspect of the present disclosure is detachably mounted to a main body of an image forming apparatus configured to form an image. The process cartridge includes a developing apparatus and an image carrying member. The developing apparatus includes a developer container configured to contain a developer, a rotation shaft, a driving transmission member, a first conveying member, and a second conveying member. The rotation shaft is disposed in the developer container and is rotatable along a predetermined rotational direction. The driving transmission member is connected to one end of the rotation shaft in an axial direction and is configured to transmit an external driving force to the rotation shaft to rotate the rotation shaft. The first conveying member is mounted to the rotation shaft, with one end being fixed as a fixed end to the rotation shaft and another end being free as a free end in a direction perpendicular to the axial direction of the rotation shaft. The second conveying member is mounted to the rotation shaft, with one end being fixed as a fixed end to the rotation shaft and another end being free as a free end in the direction perpendicular to the axial direction of the rotation shaft. A free length from the fixed end to the free end of the second conveying member is smaller than that of the first conveying member. In a rotational direction of the rotation shaft, the second conveying member is disposed upstream of the first conveying member, with the fixed end of the second conveying member and the fixed end of the first conveying member placed one on another. The free length of the second conveying member at a first position, a second position, and a third position, which sequentially distance away from the driving transmission member in the axial direction of the rotation shaft, sequentially becomes larger. The image carrying member is configured to carry an electrostatic latent image. The electrostatic latent image carried on the image carrying member is developed by the developing apparatus.

Further features and aspects of the present disclosure will become apparent from the following description of example embodiments with reference to the attached drawings.

DESCRIPTION OF THE EMBODIMENTS

The present disclosure can also be implemented in the form of a developing apparatus or a process cartridge, for example.

Hereinafter, an electrophotographic image forming apparatus incorporating a process cartridge according to an embodiment of the present disclosure will be described with reference to the drawings. The embodiments described hereinafter are examples of the present disclosure, and the dimensions, the materials, the shapes, and the relative positional relationships of the components do not limit the scope of the present disclosure unless otherwise specified.

The electrophotographic image forming apparatus is an image forming apparatus that forms an image on a printing medium using electrophotographic image forming processing. Examples of the electrophotographic image forming apparatus include an electrophotographic copying machine, an electrophotographic printer (for example, a laser printer and a light-emitting diode (LED) printer), a facsimile machine, and a word processor.

In one embodiment, the process cartridge is an integrated combination of a charging unit, a developing unit, or a cleaning unit and an electrophotographic photosensitive member and is detachably mounted to the main body of the electrophotographic image forming apparatus. In another embodiment, the process cartridge is an integrated combination of at least one of a charging unit, a developing unit, and a cleaning unit and an electrophotographic photosensitive member and is detachably mounted to the main body of the electrophotographic image forming apparatus. In still another embodiment, the process cartridge is an integrated combination of at least a developing unit and an electrophotographic photosensitive member and is detachably mounted to the main body of the electrophotographic image forming apparatus.

The developing apparatus is an integrated combination of a developing unit that develops a latent image on an electrophotographic photosensitive drum, a developing frame that supports the developing unit, and components related to the developing unit and is detachably mounted to the main body of an image forming apparatus.

A developer container unit is a unit that contains a developer for use in electrophotographic image forming processing and includes a developer container that contains the developer and a stirring unit that sends out the contained developer Example First Embodiment

[Example Electrophotographic Image Forming Apparatus]

Figure 2:
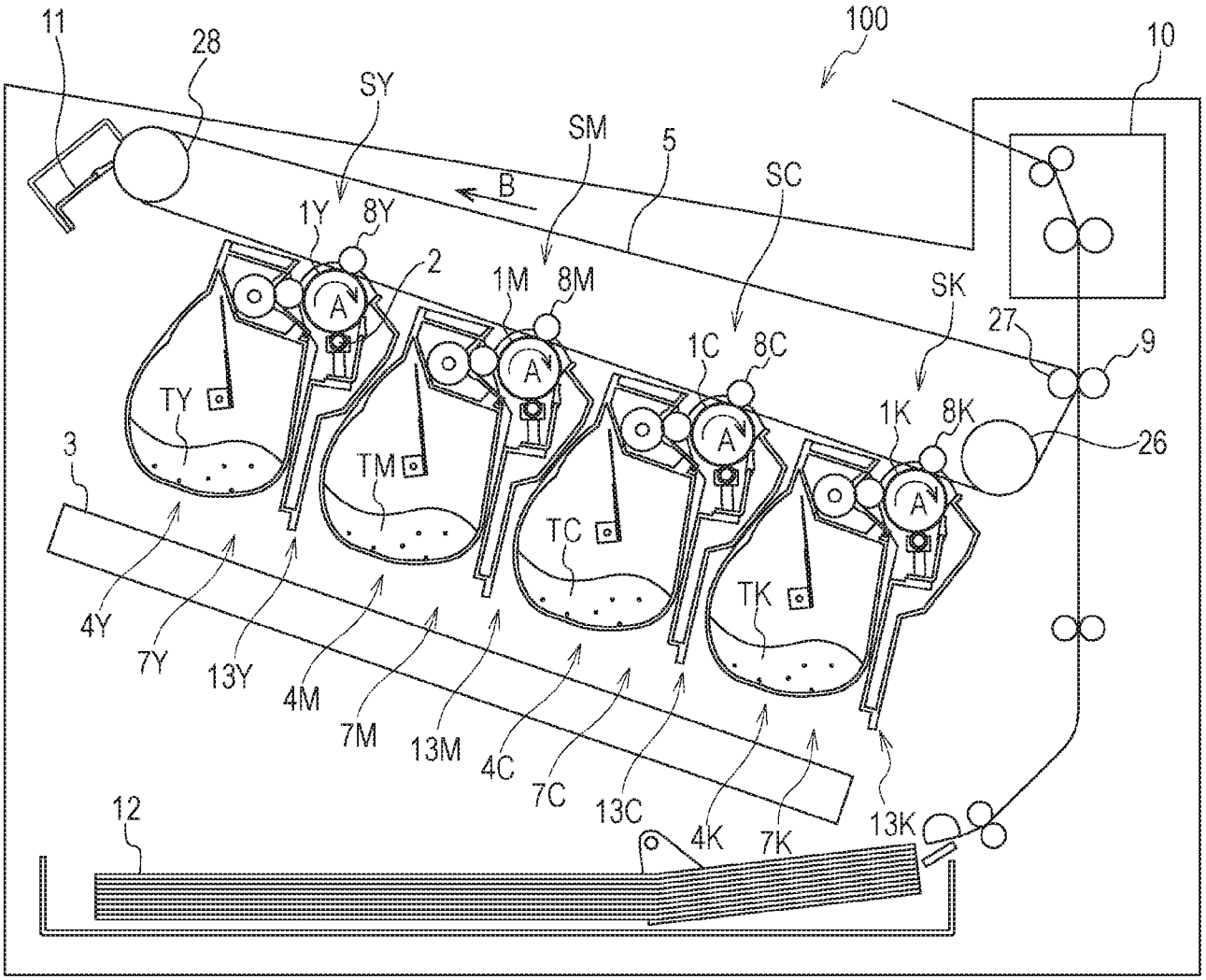
FIG. 2 is a conceptual cross-sectional view of an electrophotographic image forming apparatus incorporating the process cartridge according to the example first embodiment of the present disclosure.

Referring to FIG. 2, the overall configuration of an electrophotographic image forming apparatus (an image forming apparatus) according to an example embodiment incorporating a process cartridge according to an embodiment of the present disclosure will be described.

FIG. 2 is a conceptual cross-sectional view of an example image forming apparatus 100 incorporating the process cartridge according to the present embodiment.

As illustrated in FIG. 2, the image forming apparatus 100 of the present embodiment includes first to fourth image forming units SY, SM, SC, and SK for respectively forming images of yellow (Y), magenta (M), cyan (C), and black (K).

In the present embodiment, the configurations and operations of the first to fourth image forming units are substantially the same except that the colors of formed images differ. Accordingly, signs Y, M, C, and K will be omitted, and overall descriptions will be given if there is no need for distinction.

In the present embodiment, the image forming apparatus 100 includes four photosensitive drums 1 (1Y, 1M, 1C, and 1K) serving as image carrying members. The photosensitive drums 1 rotate in the direction of arrow A, Charging rollers 2 and a scanner unit (an exposing unit) 3 are disposed around the photosensitive drums 1.

Each charging roller 2 is a charging unit that uniformly charges the surface of each photosensitive drum 1. The scanner unit 3 is an exposing unit that emits a laser beam based on image information to form electrostatic latent images on the photosensitive drums 1. A developing apparatus (hereinafter referred to as "developing unit") 4 (4Y, 4M, 4C, and 4K) and a cleaning blade 6 (6Y, 6M, 6C, and 6K) serving as a cleaning unit are disposed around the photosensitive drum 1.

An intermediate transfer belt 5 serving as an intermediate transfer member for transferring toner images on the photosensitive drums 1 to a printing material 12 is opposed to the four photosensitive drums 1.

The developing unit 4 performs contact development using a nonmagnetic one-component developer, that is, toner T (TY, TM, TC, and TK), with a developing roller 22 serving as a developer carrying member in contact with the photosensitive drum 1.

A photoreceptor unit 13 includes the photosensitive drum 1, the charging roller 2, the cleaning blade 6, and a waste-toner accommodating unit) 14*a* (14*a*Y, 11*a*M, 14*a*C, or 14*a*K) for accommodating transfer residual toner (waste toner) remaining on the photosensitive drum 1.

In the present embodiment, the developing unit 4 and the corresponding photoreceptor unit 13 are integrated into a process cartridge 7. The process cartridge 7 is detachably mounted to the image forming apparatus 100 with a mount member, such as a mount guide or a positioning member (not illustrated), provided in the image forming apparatus 100.

As illustrated in FIG. 2, the process cartridges 7Y, 7M, 7T, and 7K of various colors have the same shape. The toner T (TY, TM, TC, and TK) of yellow (TY), magenta (TM), cyan (To, and black (TK) is contained in the corresponding process cartridge 7.

The intermediate transfer belt 5 is disposed in contact with all the photosensitive drums 1 so as to rotate in the direction of arrow B. Specifically, the intermediate transfer belt 5 is stretched across a plurality of support members (a driving roller 26, a secondary-transfer opposing roller 27, and a driven roller 28).

Four primary transfer rollers 8 (8Y, 8M, 8C, and 8K) serving as primary transfer units are arranged side by side on the inner circumferential surface of the intermediate transfer belt 5 so as to oppose the photosensitive drums 1. A secondary transfer roller 9 serving as a secondary transfer unit is disposed on the outer circumferential surface of the intermediate transfer belt 5 so as to oppose the secondary-transfer opposing roller 27. Image forming processing In image formation in the present embodiment, first, the surface of the photosensitive drum 1 is uniformly charged by the charging roller 2. Subsequently, the charged surface of the photosensitive drum 1 is scanned and exposed to a laser beam emitted from the scanner unit 3 according to image information to form an electrostatic latent image according to the image information on the photosensitive drum 1.

The electrostatic latent image formed on the photosensitive drum 1 is developed to a toner image by the developing unit 4. The toner image formed on the photosensitive drum 1 is transferred (primarily transferred) onto the intermediate transfer belt 5 by the operation of the primary transfer roller 8.

For example, in full-color image formation, the above processing is performed in sequence at the first to fourth image forming units SY, SM, SC, and SK, so that color toner images are overlaid in sequence to be primarily transferred onto the intermediate transfer belt 5. The printing material 12 is conveyed to a secondary transfer unit in synchronization with the movement of the intermediate transfer belt 5. The toner images of four colors on the intermediate transfer belt 5 are collectively secondarily transferred onto the printing material 12 by the operation of the secondary transfer roller 9 that abuts the intermediate transfer belt 5, with the printing material 12 therebetween.

The printing material 12 to which the toner images are transferred is conveyed to a fixing apparatus 10 (a fixing unit). The toner images are fixed to the printing material 12 by applying heat and pressure to the printing material 12 in the fixing apparatus 10 (image formation on the printing material 12 is completed).

Primary-transfer residual toner remaining on the photosensitive drum 1 after the primarily transferring process is removed by the cleaning blade 6. Secondary-transfer residual toner remaining on the intermediate transfer belt 5 after the secondarily transferring process is removed by an intermediate-transfer-belt cleaning unit 11.

The removed transfer residual toner (waste toner) is discharged into a waste toner box (not illustrated) of the image forming apparatus 100.

The image forming apparatus 100 is capable of forming a single-color image or a multi-color image using only a desired single image forming unit or some (not all) image forming units.

[Example Process Cartridge]

Figure 3:
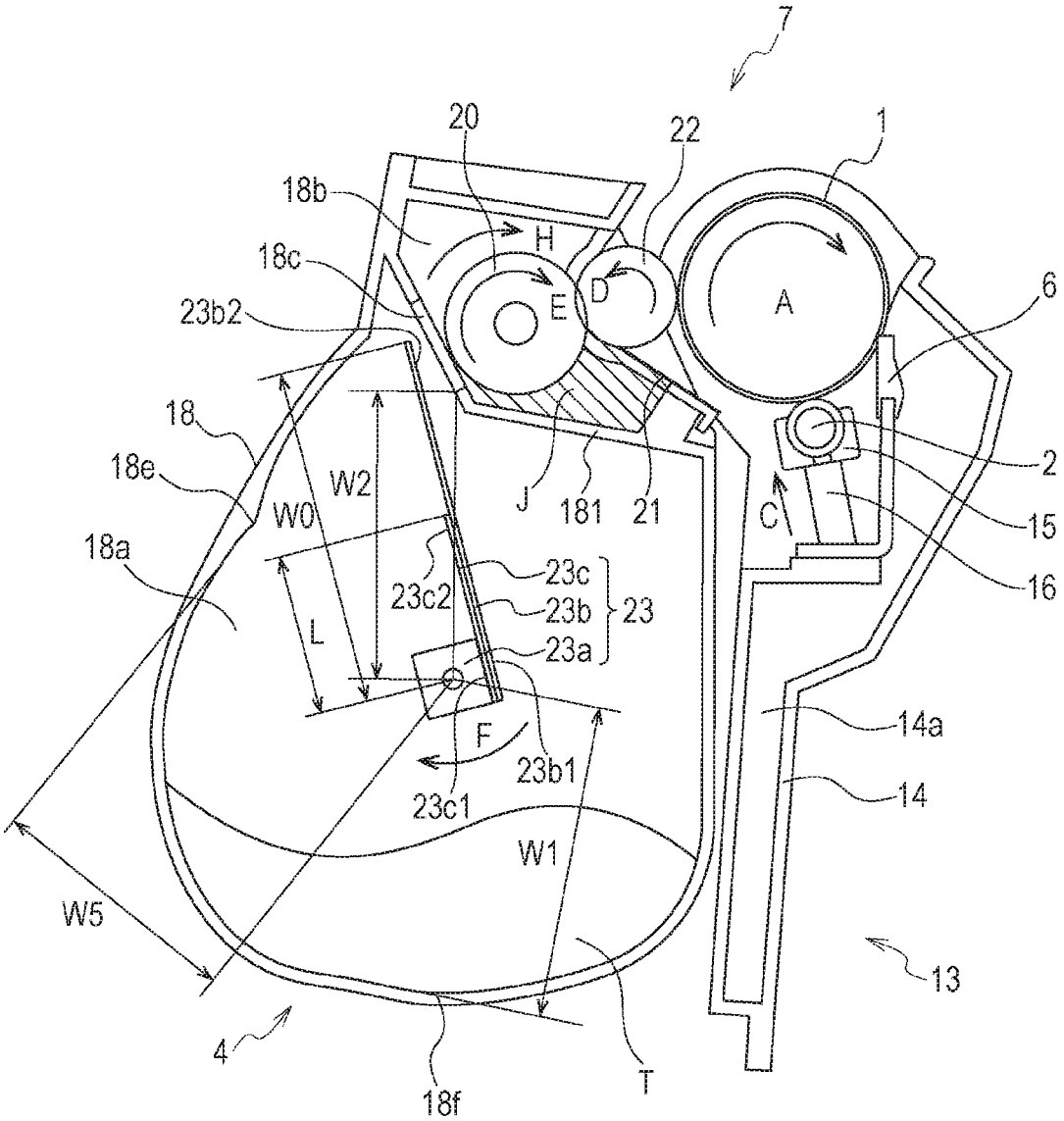
FIG. 3 is a conceptual cross-sectional view of the process cartridge according to the example first embodiment of the present disclosure.

Referring to FIG. 3, an example overall configuration of the process cartridge 7 mounted in the image forming apparatus 100 of the present embodiment will be described.

FIG. 3 is a conceptual cross-sectional view of the process cartridge 7 according to the present embodiment.

The developing unit 4 includes a developing frame 18 that supports various elements in the developing unit 4. The developing unit 4 includes the developing roller 22 serving as a developer carrying member and rotating in the direction of arrow D (counterclockwise in FIG. 3 in contact with the photosensitive drum 1.

The developing roller 22 is rotatably supported by the developing frame 18 at both ends in the longitudinal direction (the rotational axis direction) via bearings.

The developing unit 4 includes a toner container 18*a* (a developer container), a developing chamber 18*b* (a developing unit) in which the developing roller 22 is disposed), and a developer feed opening (hereinafter referred to as a toner feed opening) 18*c* communicating the toner container 18*a* and the developing chamber 18*b* with each other. In the present embodiment, the developing chamber 18*b* is located above the toner container 18*a*.

The developing chamber 18*b* includes a toner feed roller 20 serving as a developer feed member that rotates in the direction of arrow E in contact with the developing roller 22, and a developing blade 21 serving as a developer regulating member for regulating the toner layer on the developing roller 22.

The toner container 18*a* inside the developing frame 18 includes a stirring member 23 for stirring and conveying the contained toner T to the toner feed roller 20 through the toner feed opening 18*c*.

The photoreceptor unit 13 includes a cleaning frame 14 serving as a frame that supports various elements in the photoreceptor unit 13. Specifically, the photosensitive drum 1 is mounted to the cleaning frame 14 via a bearing member (not illustrated) so as to be rotatable in the direction of arrow A in FIG. 3.

A charging roller bearing 15 is attached to the cleaning frame 14 along a line passing through the rotation center of the charging roller 2 and the rotation center of the photosensitive drum 1.

The charging roller bearing 15 is attached so as to be movable in the direction of arrow C illustrated in FIG. 3. The charging roller 2 is rotatably mounted to the charging roller hearing 15. The charging roller hearing 15 is urged to the photosensitive drum 1 by a charging roller pressure spring 16 serving as an urging unit.

The cleaning blade 6 is provided to remove the transfer residual toner lisle toner) remaining on the surface of the photosensitive drum 1 after the primary transfer. The waste toner removed from the surface of the photosensitive drum 1 by the cleaning blade 6 falls in the gravitational direction into a space formed by the cleaning blade 6 and the cleaning frame 14 and is accommodated in the waste-toner accommodating unit 14*a*.

[Example Configuration of Toner Conveyance]

An example configuration for conveying the toner in the toner container 18*a* to the developing chamber 18*b* in the present embodiment will be described with reference to FIG. 1, FIG. 3 to FIGS. 5A and 5B, and FIG. 8B.

Figure 1:
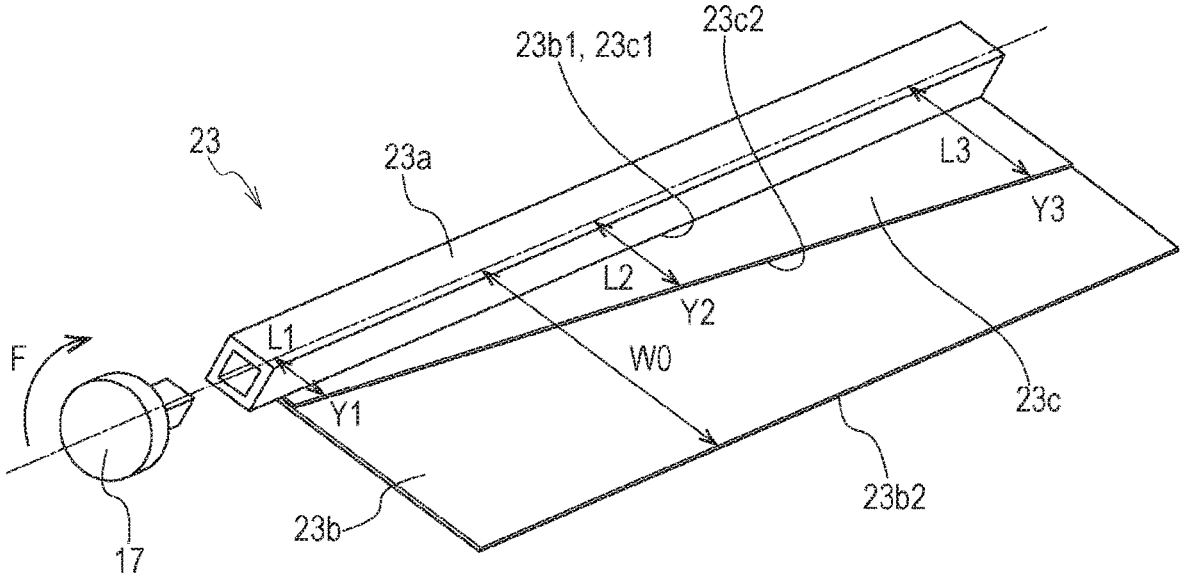
FIG. 1 is a conceptual perspective view of a toner stirring member in a process cartridge according to an example first embodiment of the present disclosure.

Specifically, FIG. 1 is a conceptual perspective view of the toner stirring member 23 in the process cartridge 7 according to the first embodiment of the present disclosure.

FIGS. 4A to 4E are conceptual cross-sectional views of the process cartridge 7 on a driving side in the longitudinal direction according to the first embodiment of the present disclosure. More specifically, FIGS. 4A to 4E illustrate a cross section of the process cartridge 7 at an end of the stirring sheet 23*b* in the longitudinal direction of the process cartridge 7 where a driving transmission member 17 is present (hereinafter referred to as "driving side).

Figure 5A:
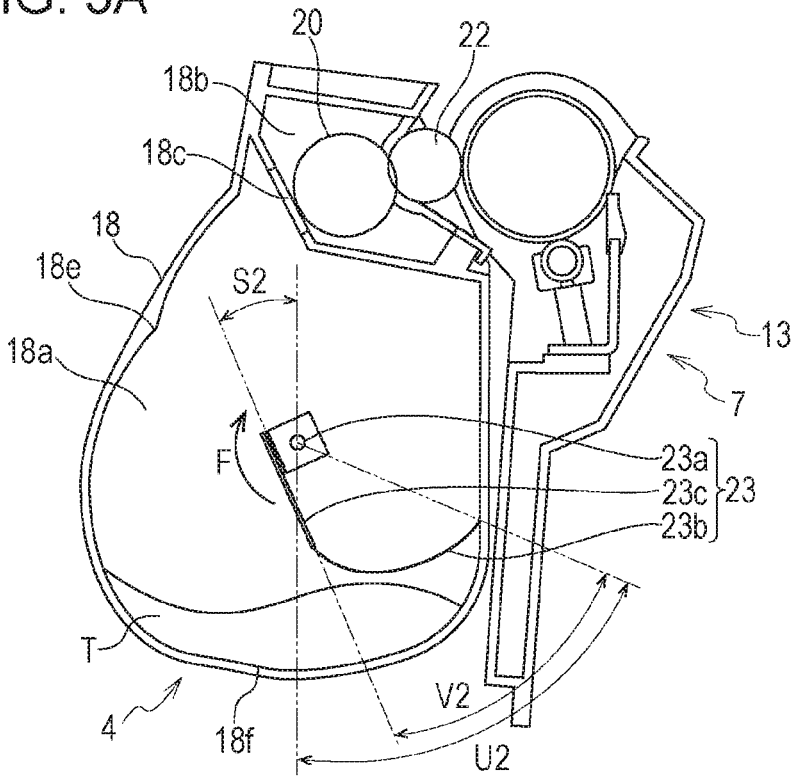
FIGS. 5A and 5B are conceptual cross-sectional views of the process cartridge on a non-driving side in the longitudinal direction according to the example first embodiment of the present disclosure.
Figure 5B:
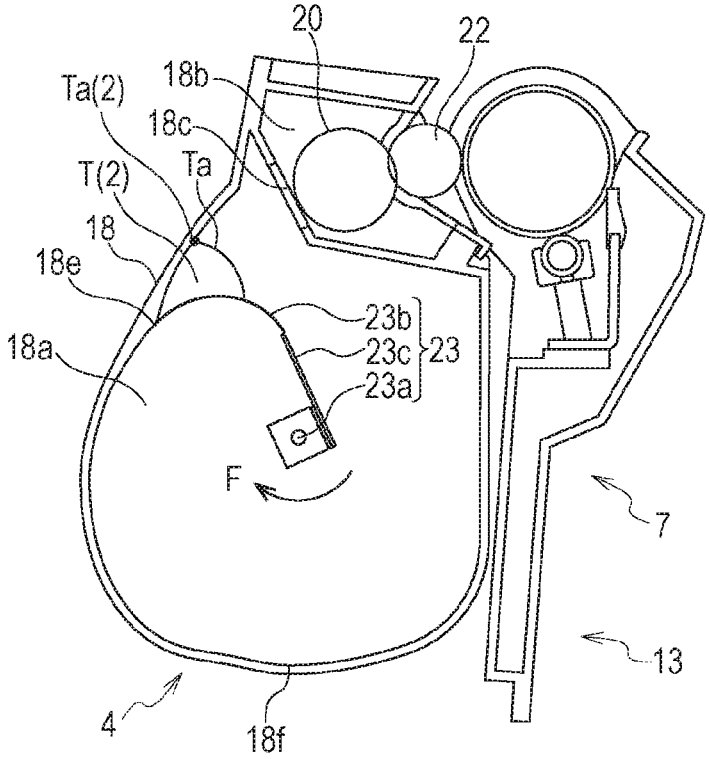

FIGS. 5A and 5B are conceptual cross-sectional views of the process cartridge 7 on a non-driving side in the longitudinal direction according to the first embodiment of the present disclosure. More specifically, FIGS. 5A and 5B illustrate a cross section of the process cartridge 7 at an end of the stirring sheet 23*b* in the longitudinal direction of the process cartridge 7 where the driving transmission member 17 is not present (hereinafter referred to as "non-driving side) opposite to the side on which the driving transmission member 17 is present.

Figure 8A:
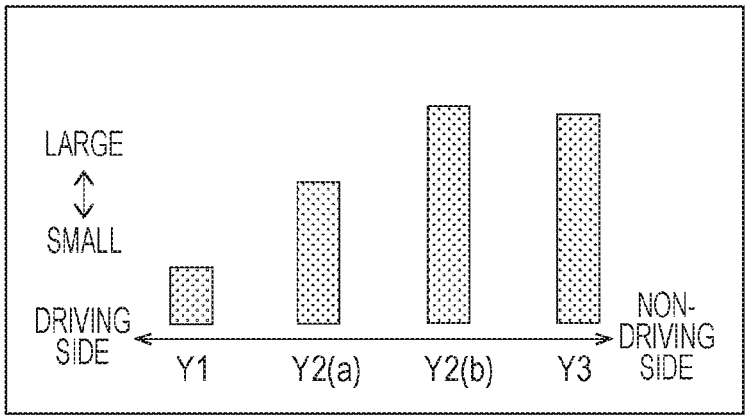
FIG. 8A is a graph illustrating the relationship between the longitudinal position of the toner conveying member in the known process cartridge and the amount of toner conveyed.
Figure 8B:
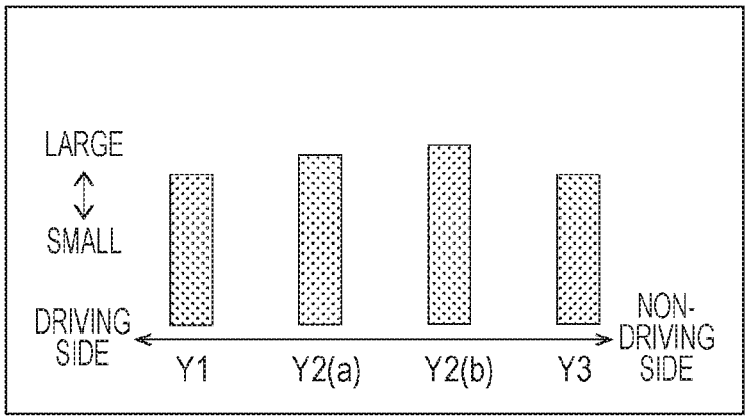
FIG. 8B is a graph illustrating the relationship between the longitudinal position of the toner conveying member of the process cartridge according to the example first embodiment of the present disclosure and the amount of toner conveyed.

FIG. 8B is a diagram illustrating the relationship between the position of the toner conveying member in the process cartridge 7 in the longitudinal direction and the amount of toner conveyed according to the first embodiment of the present disclosure.

As illustrated in FIG. 3, the stirring member 23 in the present embodiment includes a rotation shaft 23*a*, a stirring sheet 23*b* (a first conveying member), which is a flexible sheet attached to the rotation shaft 23*a* at one end, and a backup sheet 23*c* (a second conveying member). The rotation shaft 23*a* of the stirring member 23 is disposed substantially parallel to the rotation axis of the developing roller 22.

Figure 4A:
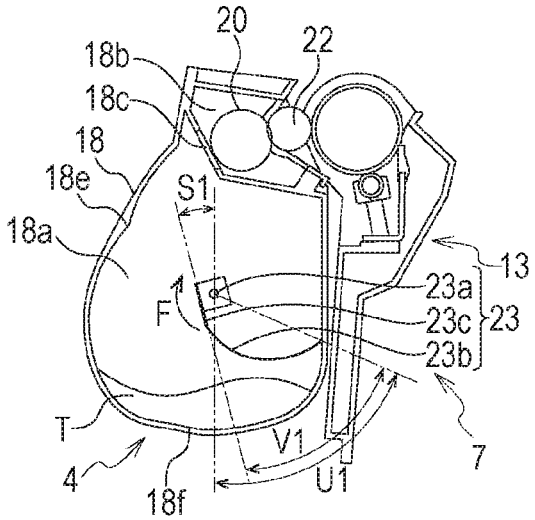
FIGS. 4A to 4E are conceptual cross-sectional views of the process cartridge on a driving side in the longitudinal direction according to the example first embodiment of the present disclosure.
Figure 4B:
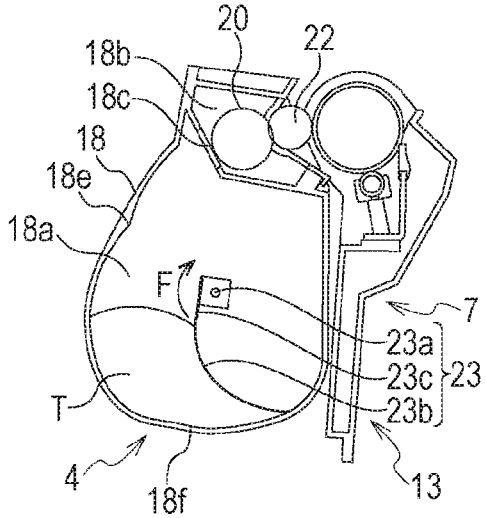
Figure 4C:
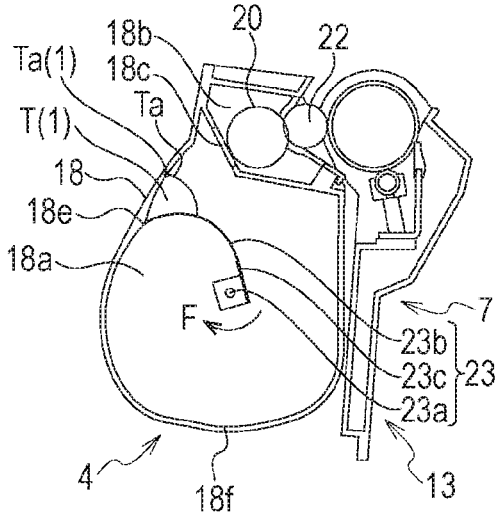

As illustrated in FIG. 1, the driving transmission member 17 is provided at one end of the rotation shaft 23*a* in the rotational axis direction. The driving transmission member 17 is rotationally driven in the direction of arrow F (rotational direction) by receiving driving from the main body. As illustrated in FIGS. 4A to 4C, the rotation of the stirring member 23 in the rotational direction F allows the stirring sheet 23*b* to convey the developer while contacting the inner wall of the toner container 18*a* into a bent state. When the stirring sheet 23*b* is released from the bent state, the toner on the stirring sheet 23*b* is spattered up by the elastic returning force of the stirring sheet 23*b* and is conveyed (fed) to the toner supply roller 20 in the developing chamber 18*b* through the toner supply opening 18*c*.

As illustrated in FIG. 1, the length W0 (free length) of the stirring sheet 23*b* from a fixed end 23*b*1 (the rotation shaft 23*a*) to a free end 23*b*2 (a distal end) in the present embodiment is constant in the rotational axis direction of the rotation shaft 23*a*.

The length L (free length) of the backup sheet 23*c* from a fixed end 23*c*1 (the rotation shaft 23*a*) to a free end 23*c*2 (a distal end) is smaller than W0.

The backup sheet 23*c* is configured to satisfy L1<L2<L3, where L1 is the free length at a position Y1 on the driving transmission member side, L2 is the free length of a central position Y2, and L3 is the free length of a position Y3 on the non-driving transmission member side in the rotational axis direction of the rotation shaft 23*a*.

In other words, as illustrated in FIG. 1, the free length of the backup sheet 23*c* may be set so as to satisfy L1<L2<L3 toward the non-driving side (Y3) from the driving side (Y1) in the axial direction.

Thus, in the present embodiment, the developing unit (developing apparatus) 4 in the process cartridge 7 includes a developer container (18*a*) that contains a developer and the rotation shaft 23*a* that is disposed in the developer container 18*a* and that is rotatable along a predetermined rotational direction. The driving transmission ember 17 that transmits a driving force from the outside (the main body of the image forming apparatus) to the rotation shaft 23*a* to rotate the rotation shaft 23*a* is connected to one end of the rotation shaft 23*a* in the axial direction.

The rotation shaft 23*a* is fitted with the first conveying member (23*b*) and the second conveying member (23*c*). In the direction perpendicular to the axial direction of the rotation shaft 23*a*, the first conveying member (23*b*) is attached to the rotation shaft 23*a* at one end (a fixed end) and at the other end (a free end). In the direction perpendicular to the axial direction of the rotation shaft 23*a*, the second conveying member (23*c*) is attached to the rotation shaft 23*a* at one end (a fixed end) and at the other end (a free end) The free length (L) of the second conveying member (23*c*) from the fixed end to the free end is smaller than the free length (W0) of the first conveying member (23*b*).

In the rotational direction F of the rotation shaft 23*a*, the second conveying member (23*c*) is disposed upstream of the first conveying member (23*b*), with the fixed end (23*c*1) of the second conveying member (23*c*) and the fixed end (23*b*1) of the first conveying member (23*b*) placed one on another.

The free lengths (L1, L2, and L3) of the second conveying member (23*c*) at a first position Y1, a second position Y2, and a third position Y3, which sequentially distance away from the driving transmission member 17 in order along the axial direction of the rotation shaft 23*a*, sequentially becomes larger (L1<L2<L3).

In particular, in the present embodiment, the free length L of the second conveying member (23*c*) may be continuously changed in the axial direction of the rotation shaft 23*a*.

In the present embodiment, the free length L of the second conveying member (23*c*) may be changed in the entire area of the rotation shaft 23*a* in the axial direction.

The stirring sheet 23*b* (the first conveying member) and the backup sheet 23*c* (the second conveying member), which are features of the present disclosure, will be described in more detail.

As illustrated in FIG. 1, in the present embodiment, the bending rigidity of the stirring sheet 23*b* is set larger than the bending rigidity of the backup sheet 23*c*.

The material of the stirring sheet 23*b* and the material of the backup sheet 23*c* may not be the same. The stirring sheet 23*b* may be a combination of flexible resin sheets, such as a polyester film, a polyphenylene sulfide film, and a polycarbonate film.

Specifically, in the present embodiment, the stirring sheet 23*b* may be a polycarbonate film with a thickness of about 100 μm to 200 μm. The backup sheet 23*c* may be a polyester film with a thickness of about 200 to 300 μm. In this case, the bending rigidity of the backup sheet 23*c* is set to be about three times the bending rigidity of the stirring sheet 23*b*.

The stirring member 23 and the state (amount) of the toner on the stirring sheet 23*b* of the process cartridge 7 on the driving side (Y1) when the stirring member 23 makes one rotation will be described in detail with reference to FIGS. 4A to 4E.

FIG. 4A illustrates the state of a phase in which the stirring sheet 23*b* starts to push the toner surface (developer surface). Thereafter, the stirring sheet 23*b* rotates in the direction of arrow F to reach the phase in FIG. 4B, thereby conveying the toner.

The length of the stirring sheet 23*b* is set so that the toner on the bottom 18*f* of the toner container 18*a* can be stirred and conveyed. Specifically, as illustrated in FIG. 3, the length W0 from the rotation axis of the rotation shaft 23*a* to the distal end of the stirring sheet 23*b* and the length W1 from the rotation shaft 23*a* to the bottom 18*f* of the toner container 18*a* are set so as to satisfy W0>W1.

When the stirring sheet 23*b* is continuously rotated in the direction of arrow F, the stirring sheet 23*b* reaches the phase of a release position 18*e*, as illustrated in FIG. 4C. The stirring sheet 23*b* carries the conveyed toner. The stirring sheet 23*b* is released from the bent state immediately after the stirring sheet 23*b* passes through the release position 18*e*, so that the toner is spattered up toward the toner supply opening 18*c*.

The free length of the backup sheet 23*c* needs to be set so as not to inhibit the operation of releasing the stirring sheet 23*b* from its bent state. In other words, it is necessary to set the length L from the fixed end 23*c*1 to the free end 23*c*2 of the backup sheet 23*c* fixed to the same position as the position of the stirring sheet 23*b* (the fixed ends 23*b*1 and 23*c*1) at which the backup sheet 23*c* is laid on the stirring sheet 23*b*, Specifically, as illustrated in FIG. 3, the length L of the backup sheet 23*c* from the fixed end 23*c*1 to the free end 23*c*2 is set to be smaller than the length W5 from the rotation axis of the rotation shaft 23*a* to the release position 18*e*.

Figure 4D:
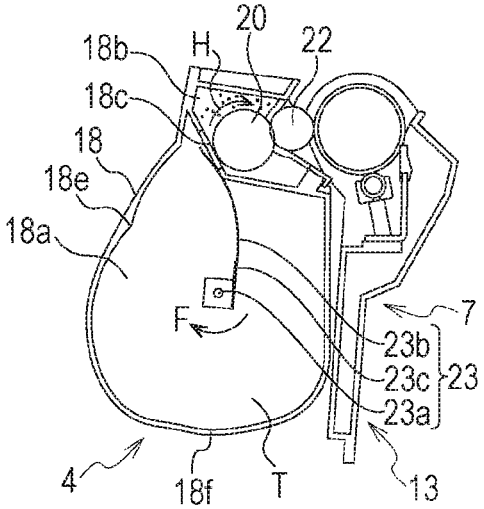
Figure 4E:
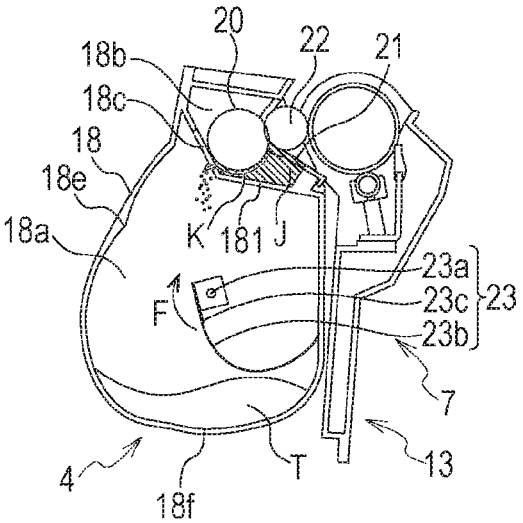

Subsequently, as illustrated in FIG. 4D, the stirring sheet 23*b* conveys the toner to the toner feed opening 18*c* and collides with the toner feed opening 18*c* due to the force of returning from the bent state to the released state (returning force) to push the toner into the developing chamber 18*b*.

As illustrated in FIG. 3, the length W0 of the stirring sheet 23*b* is set to satisfy W0>W2, where W2 is a length from the stirring shaft 23*a* to the lower end of the toner feed opening 18*c* so that the toner can be stably conveyed to the developing chamber 18*b*.

Thereafter, the stirring sheet 23*b* rotates in the direction of arrow F to return to the phase of the stirring sheet 23*b* illustrated in FIG. 4A. The stirring sheet 23*b* continuously rotates in the rotational direction F, and every time the stirring sheet 23*b* passes through the phase of the release position 18*e*, the stirring sheet 23*b* spatters up the toner on the stirring sheet 23*b* to convey the toner into the developing chamber 18*b* through the toner feed opening 18*c*.

As illustrated in FIG. 4D, the toner conveyed from the toner container 18*a* is conveyed toward the toner feed roller 20 and the developing roller 22 through the toner feed opening 18*c* (the direction of arrow H).

Thereafter, the toner moves to the contact portion between the toner feed roller 20 and the developing roller 22, and part of the toner is fed to the developing roller 22. Toner that has not been fed to the developing roller 22 is conveyed by the rotation of the developing roller 22 and the toner feed roller 20 into an area J enclosed by the developing blade 21, the developing roller 22, the toner feed roller 20, and the bottom 181 of the developing chamber 18*b* illustrated in FIG. 4E.

When a sufficient amount of toner is fed to the developing chamber 18*b*, the area J is filled with the toner, and excessive toner is returned to the toner container 18*a* (in the direction of arrow K) through the toner feed opening 18*c* by the rotation of the toner feed roller 20.

Thus, conveying a sufficient amount of toner from the toner container 18*a* to the developing chamber 18*b* allows the image density to be stabilized. The circulation of the toner through the toner container 18*a* and the developing chamber 18*b* makes degradation of the toner as uniform as possible, allowing providing a good-quality image.

Referring next to FIGS. 5A and 5B, the state of the stirring member 23 and the toner on the non-driving side (Y3) of the process cartridge 7 when the stirring member 23 makes one rotation will be described in detail.

The features of the configuration of the present embodiment illustrated in FIGS. 5A and 5B will be described using a known configuration illustrated in FIG. 6 and FIGS. 7A and 7B as a comparative example.

Figure 6:
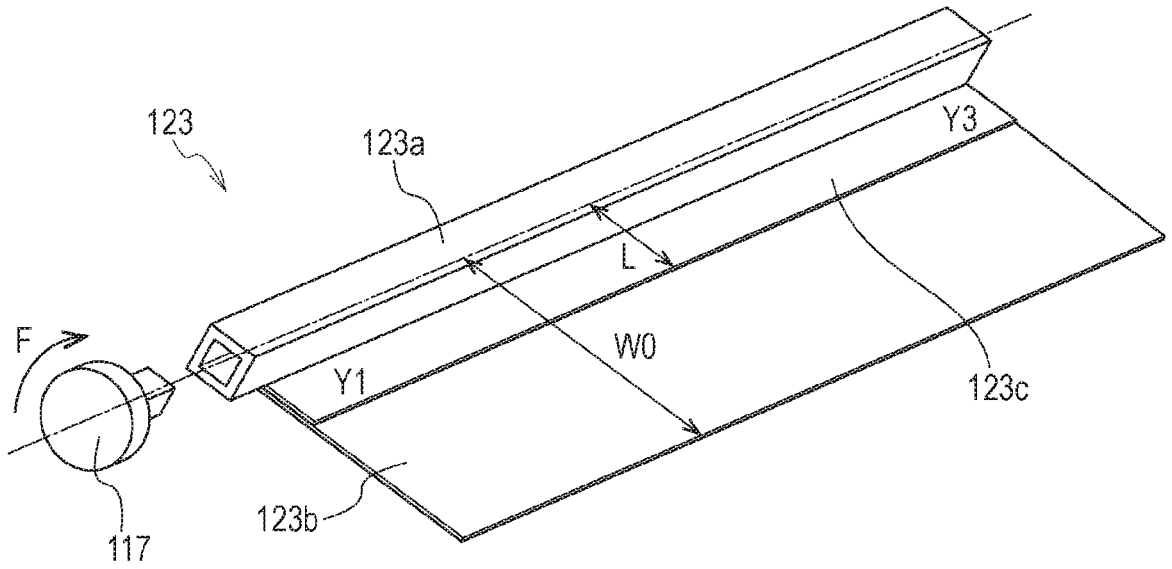
FIG. 6 is a perspective view of a toner stirring member in a known process cartridge.

Specifically, FIG. 6 is a perspective view of a toner stirring member in a known process cartridge. FIGS. 7A and 7B are cross-sectional views of the known process cartridge on the non-driving side in the longitudinal direction.

In the known configuration illustrated herein, the length (the free length) L from the fixed end (the rotation shaft 123*a*) to the free end (the distal end) of a backup sheet 123*c* is constant in the rotational axis direction of the rotation shaft 123*a*, as illustrated in FIG. 6. In other words, the free length of the backup sheet 123*c* is the same (constant) on the driving side (Y1) and on the non-driving side (Y3). The backup sheet 123*c* exhibits the same behavior on the driving side (Y1) and the non-driving side (Y3) in the case where the free length is constant and in the case where the backup sheet 123*c* is not provided.

Figure 7A:
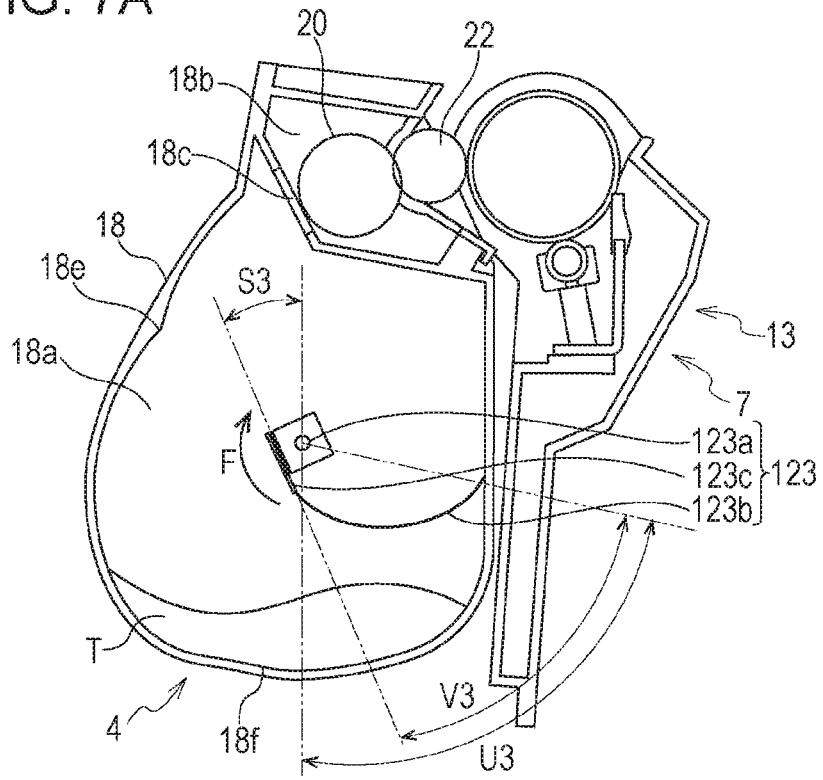
FIGS. 7A and 7B are cross-sectional views of the known process cartridge on the non-driving side in the longitudinal direction.
Figure 7B:
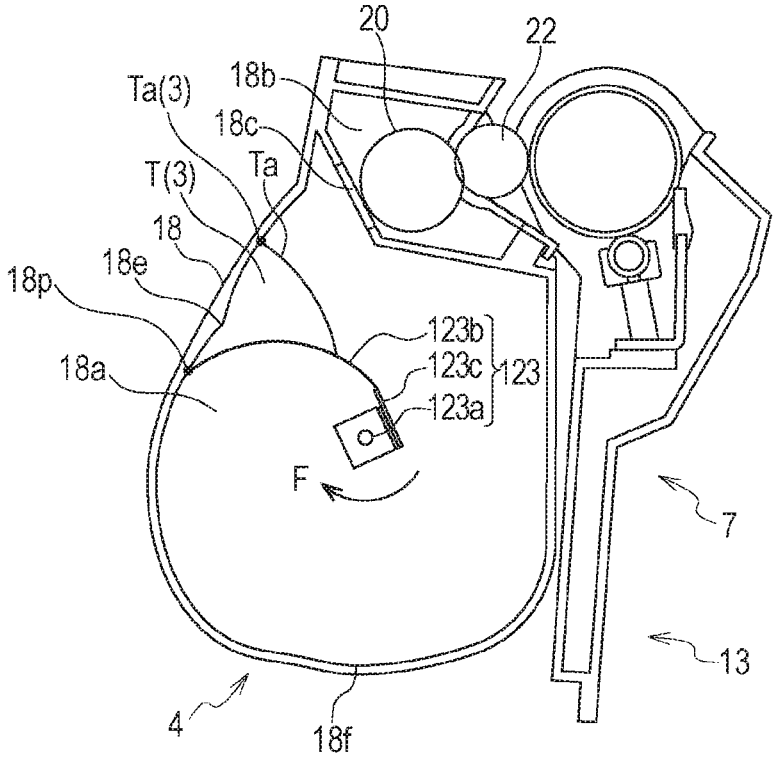

FIGS. 5A and 5B (the present embodiment) and FIGS. 7A and 7B (the known configuration) illustrate the cross sections of the process cartridge 7 on the non-driving side (Y3) at the same timing as the timing on the driving side (Y1) in the present embodiment illustrated in FIGS. 4A and 4C. Since the known configuration and the configuration of the present embodiment on the driving side (Y1) are the same, the driving side (Y1) of the known configuration can be understood with reference to FIGS. 4A to 4E. That is to say, FIGS. 4A to 4E show both the known configuration and the configuration of the present embodiment on the driving side (Y1).

In other words, FIG. 4A and FIG. 5A respectively illustrate the cross sections of the process cartridge 7 of the present embodiment on the driving side (Y1) and the non-driving side (Y3) at the same timing (a).

FIG. 4C and FIG. 5B respectively illustrate the cross sections of the process cartridge 7 of the present embodiment on the driving side (Y1) and the non-driving side (Y3) at the same timing (c).

FIG. 4A and FIG. 7A respectively illustrate the cross sections of the process cartridge with the known configuration on the driving side and the process cartridge with the known configuration on the non-driving side at the same timing (a), FIG. 4C and FIG. 7B respectively illustrate the cross sections of the process cartridge with the known configuration on the driving side and the process cartridge with the known configuration on the non-driving side at the same timing (c).

As illustrated in FIG. 4A and FIG. 5A, in the configuration of the present embodiment, the angle S1 on the driving side that the rotation shaft 23*a* forms with the vertical direction (see FIG. 4A) and the angle S2 on the non-driving side that the rotation shaft 23*a* forms with the vertical direction (see FIG. 5A) differ (S2>S1).

This is because the rotation shaft 23*a* is twisted in the direction opposite to the rotational direction F due to the difference in rotational reaction force opposite to the rotational direction F of the rotation shaft 23*a* between the driving side (Y1) and the non-driving side (Y3). The term "rotational reaction force" may include a reaction force caused when the stirring sheet 23*b* rotates while touching the inner surface of the toner container 18*a* and a reaction force caused when the stirring sheet 23*b* conveys the toner.

These rotational reaction forces generate in the entire area in the longitudinal direction from the driving side (Y1) to the non-driving side (Y3). On the "driving side (Y1)" of the rotation shaft 23*a* rotationally driven by the driving transmission member 17, the rotation shaft 23*a* can rotate with no phase delay with respect to the driving transmission member 17.

On the "non-driving side (Y3)" in contrast to the "driving side (Y1)", the rotation shaft 23*a* is rotated by the rotational force transmitted from the driving side, and the terminal end on the non-driving side (Y3) becomes the free end of the twist. Thus, upon receiving the "rotational reaction force", the rotation shaft 23*a* is twisted in the direction opposite to the rotational direction F.

A conceivable method for inhibiting the twist of the rotation shaft 23*a* is changing the material of the rotation shaft 23*a* to metal, but this may cause the problem of increasing the cost.

The known configuration of the comparative example will be described.

In the known configuration, as illustrated in FIG. 6, the free length L of the backup sheet 123*c* from the fixed end (a rotation shaft 123*a*) to the free end (the distal end) is constant (the same length) in the rotational axis direction of the rotation shaft 123*a*.

Also in the known configuration, the angle that the rotation shaft 123*a* on the driving side (Y1) forms with the vertical direction (see "S1" in FIG. 4A) and the angle that the rotation shaft 123*a* on the non-driving side (Y3) forms with the vertical direction (see "S3" in FIG. 7A) differ (S3>S1).

In the known configuration, the twist of the rotation shaft 123*a* causes the angles formed between (I) a line connecting the rotation shaft 123*a* of the stirring member 123 and a position at which the distal end of the stirring sheet 123*b* comes into contact with the inner surface of toner container 18*a* and (II) the vertical direction differ regarding to the axial direction of the rotation shaft (U3>U1). Specifically, the angle on the driving side (Y1) (see "U1" in FIG. 4A) and the angle on the non-driving side (Y3) (see "U3" in FIG. 7A) differ (U3>U1).

In contrast, in the configuration of the present embodiment, the angle U1 on the driving side Y1 (see FIG. 4A) and the angle U2 on the non-driving side (see FIG. 5A) are substantially the same.

In the known configuration, since the rotation shaft 123*a* rotated by the driving transmission member 117 is twisted, the phase of the position of the distal end of the stirring sheet 123*b* on the non-driving side (Y3) is delayed from the driving side (Y1). The distal end of the stirring sheet 123*b* (see 23*b* as illustrated in FIG. 4C) on the driving side (Y1) has reached the release position 18*e*. However, on the non-driving side (Y3), the distal end of the stirring sheet 123*b* (see FIG. 7B) is present on a position 18*p* and has not yet reached the release position 18*e*.

At that time, a toner surface Ta is substantially uniform (at the same height) in the rotational axis direction on the driving side (Y1) and on the non-driving side (Y3) (Ta(1)=Ta(3)). Therefore, the amount of the toner on the stirring sheet 123*b* is "non-uniform" because of the position of the free end of the stirring sheet 123*b*. In other words, on the driving side (Y1), the free end of the stirring sheet 123*b* is present at the position 18*e*, and the amount of toner accumulated between the upper surface of the stirring sheet 123*b* and the toner surface Ta(1) is T(1).

At this timing, on the non-driving side, the free end of the stirring sheet 123*b* is present at the position 18*p*, and the amount of toner accumulated between the upper surface of the stirring sheet 123*b* and the toner surface Ta(3) (=Ta(1)) is T(3). As can be seen from FIG. 4C and FIG. 7B, T(3) is larger than T(1).

In other words, the amount of toner accumulated is smaller on the "driving side (Y1)" than on the "non-driving side (Y3)". Therefore, the amount of toner spattered up by the stirring sheet 123*h* when the free end of the stirring sheet 123*b* is released after passing through the release position is smaller on the "driving side (Y1)" than on the "non-driving side (Y3)" (that is, non-uniform in the axial direction).

In the known configuration, the release timing of the stirring sheet 123*b* is delayed on the non-driving side (Y3) from the driving side (Y1). This causes the force Z with which the stirring sheet 123*b* spatters up the toner at the release of the stirring sheet 123*b* to increase on the non-driving side (Y3), so that the amount of toner that the stirring sheet 123*b* spatters up is smaller on the driving side (Y1) than on the non-driving side (Y3).

Thus, in the known configuration, it is difficult to convey a sufficient amount of toner from the toner container 18*a* to the developing chamber 181 on the driving side (Y1) where the toner feed amount is small. This may make it difficult to stabilize the image density in the longitudinal direction. Furthermore, non-uniform toner degradation in the longitudinal direction may further decrease the image quality.

In contrast, in the present embodiment, as illustrated in FIG. 4C and FIG. 5B, even if the rotation shaft 23*a* is twisted, the phase of the distal end position of the stirring sheet 23*b* is not delayed on the non-driving side Y3 from on the driving side Y1 (that is, on the same phase position 18*e*).

Therefore, the amounts of toner, T1 and T2, accumulated between the upper surface of the stirring sheet 23*b* and the toner surface Ta(1) (=Ta(2)) on both of the driving side Y1 and the non-driving side Y3 are substantially the same (T1=T2).

Thus, the configuration of the stirring member 23 of the present embodiment allows the amount of toner fed to the developing chamber more to be uniform in the rotational axis direction.

In the present embodiment, the free length L of the backup sheet 23*c* of the stirring member 23 from the fixed end 23*c*1 (the rotation shaft 23*a*) to the free end (the distal end) is set to satisfy L1<L2<L3 in the rotational axis direction. The free length L of the backup sheet 23*c* is L1 on the driving transmission member side Y1, L2 at the center, and L3 on the non driving transmission member side.

In the configuration of the present embodiment, as illustrated in FIG. 4A and FIG. 5A, the angle U1 and the angle U2 that the rotation shaft 23*a* forms with the vertical direction are substantially the same even if the angle S1 on the driving side Y1 and the angle S2 on the non-driving side Y3 differ. Specifically, the angle U1 and the angle U2 that a line connecting the rotation shaft 23*a* of the stirring member 23 and the position 18*e* at which the distal end of the stirring sheet 23*b* comes into contact with the inner surface of the toner container 18*a* forms with the vertical direction on the driving side Y1 and on the non-driving side Y3, respectively, are substantially the same.

This may be because even if the phase of the rotation shaft 23*a* is delayed on the non-driving side Y3 due to the twist of the rotation shaft 23*a*, the phase delay due to the bending of the stirring sheet 23*b* on the non-driving side Y3 can be smaller than on the driving side Y1.

Furthermore, setting the free length L1 of the backup sheet 23*c* on the driving side Y1 smaller than the free length L3 on the non-driving side Y3 allows the amount of bending of the stirring sheet 23*b* to be smaller on the non-driving side Y3 than on the driving side Y1.

In other words, as in the present embodiment, the torsional phase difference of the rotation shaft 23*a* between the driving side Y1 and the non-driving side Y3 (|angle S1−angle S2|) and the deflection phase difference of the stirring sheet 23*b* between the driving side Y1 and the non-driving side Y3 (|angle V1−angle V2|) can be made substantially the same. The phase difference (angle V) can be the angle V formed between (I) the line connecting the rotation shaft 23*a* of the stirring member 23 and the distal end position of the stirring sheet 23*b* and (II) the vertical direction. Furthermore, the phase difference (angle V) can be the angle V1 on the driving side (see FIG. 4A), and the angle V2 on the non-driving side Y3 (see FIG. 5A).

Thus, in the present embodiment, even if the rotation shaft 23*a* is twisted, the phase of the distal end position of the stirring sheet 23*b* can be made substantially the same on the driving side Y1 and on the non-driving side Y3.

In other words, as illustrated in FIG. 4C and FIG. 5B, the distal ends of the stirring sheet 23*b* on the driving side Y1 and the non-driving side Y3 can reach the release position 18*e* at substantially the same time. At that time, the toner surface Ta is substantially uniform in the rotational axis direction. Therefore, the amount of toner on the stirring sheet 23*b* is substantially the same on the driving side Y1 and on the non-driving side Y3. This allows the amount of toner that the stirring sheet 23*b* spatters up at the releasing of the stirring sheet 23*b* to be substantially the same on the driving side Y1 and on the non-driving side Y3.

Since the timing of releasing the stirring sheet 23*b* is substantially the same on the driving side Y1 and the non-driving side Y3, as in the present embodiment, the force Z with which the stirring sheet 23*b* spatters the toner at the releasing of the stirring sheet 23*b* is substantially the same on the driving side Y1 and on the non-driving side Y3.

FIGS. 8A and 8B illustrate the verification results of the effects of adjustment of the free length L of the backup sheet 23*c*.

FIG. 8A illustrates the relationship between the longitudinal position of the toner conveying member in the process cartridge of the known configuration and the amount of toner conveyed. FIG. 8B illustrates the relationship between the longitudinal position of the toner conveying member of the process cartridge 7 according to the first embodiment of the present disclosure and the amount of toner conveyed.

Specifically, FIG. 8A and FIG. 8B respectively illustrate the amounts of toner conveyed in areas at positions (Y1, Y2(*a*), Y2(*b*), and Y3) obtained by dividing the process cartridge 7 containing the same amount of toner in the longitudinal direction into four in the known configuration and the configuration of the present embodiment.

The horizontal axes in FIGS. 8A and 8B are plotted to four divided portions of the process cartridge 7 in the longitudinal direction, that is, the driving side Y1, the central portion adjacent to the driving side Y2(*a*), the central portion adjacent to the non-driving side Y2(*b*), and the non-driving side Y3 from the left. The vertical axes in FIGS. 8A and 8B represent the amount of toner conveyed from the toner container 18*a* to the developing chamber 18*b*.

As illustrated in FIG. 8A, in the known configuration, the amount of toner conveyed on the driving side Y1 is very smaller than the amount on the non-driving side Y3. In contrast, in the configuration of the present embodiment as illustrated in FIG. 8B, the amount of toner conveyed on the driving side Y1 is substantially the same as the amount on the non-driving side (Y3).

In the known configuration and the configuration of the present embodiment, as seen from FIGS. 8A and 8B, the total amounts of toner conveyed in the entire area in the longitudinal direction are substantially the same, but the distribution of the amount of toner in the longitudinal direction is more uniform in the present embodiment.

This is because the timing of releasing the stirring sheet 23*b* in the configuration of the present embodiment is substantially the same on the driving side Y1 and on the non-driving side Y3. Thus, the amount of toner on the stirring sheet 23*b* and the force Z by which the toner is spattered up by the stirring sheet 23*b* are substantially the same on the driving side Y1 and on the non-driving side Y3.

The configuration of the present embodiment allows the image density in the longitudinal direction to be stabilized by making the toner feed amount uniform in the longitudinal direction of the process cartridge 7. The configuration also allows a change in durability of the toner to be uniform in the longitudinal direction, providing higher-quality images.

The developing apparatus of the present embodiment may be configured as a toner conveying apparatus for conveying toner, a cleaning unit, or part of an image forming apparatus.

Other Example Embodiments

In the present embodiment, he first conveying member (23*b*) and the second conveying member (23*c*) may be elastic sheet-like members. This allows toner to be conveyed (fed) by the elastic deformation of the sheets.

The second conveying member (23*c*) may be thicker than the first conveying member (23*b*). This allows the toner fed in the axial direction to be more uniform.

The second conveying member (23*c*) may have a higher bending elastic modulus than the bending elastic modulus of the first conveying member (23*b*). This allows the toner fed in the axial direction to be more uniform.

In the present embodiment, the developing unit 4 (the developing apparatus) of the process cartridge includes the developing unit (I 8*b*) and the opening (18*c*). Specifically, the developing unit (18*b*) is disposed above the developer container (18*a*) and houses the developer carrying member carrying a developer. The opening (18*c*) can communicate the developer container (18*a*) and the developing unit (18*b*) with each other.

In the present embodiment, the developing unit 4 (the developing apparatus) of the process cartridge may be configured to be detachably mounted to the main body of the image forming apparatus.

In the present embodiment, the process cartridge is detachably mounted to the main body of the image forming apparatus and may include the developing unit 4 (the developing apparatus) and the drum 1 (the image carrying member) carrying an electrostatic latent image. The electrostatic latent image carried on the image carrying member is developed by the developing unit 4 (the developing apparatus).

Example Second Embodiment

Figure 9:
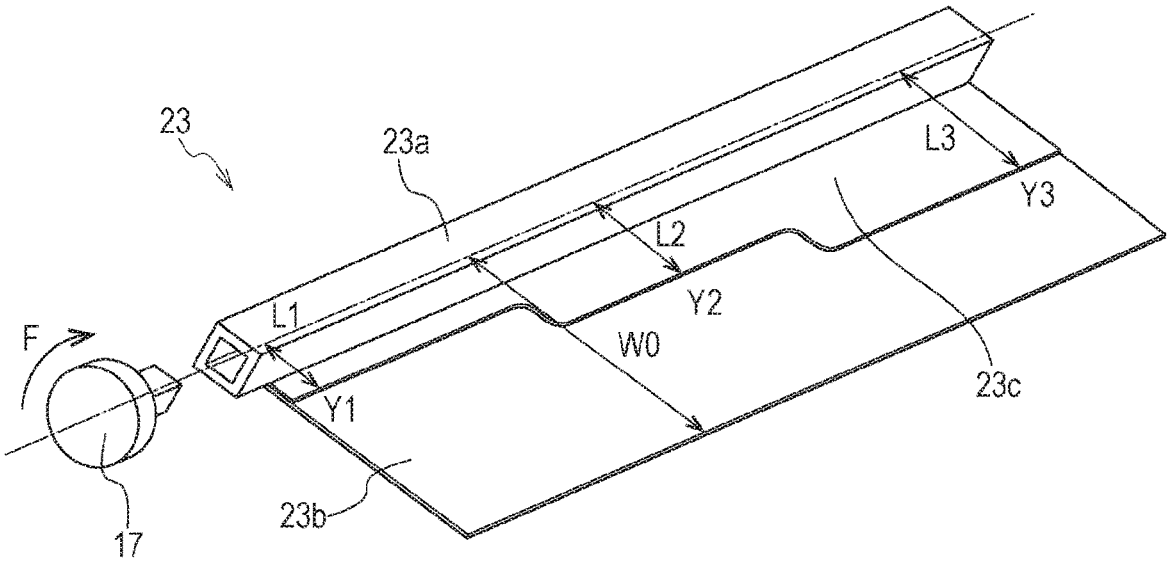
FIG. 9 is a conceptual perspective view of a toner stirring member in a process cartridge according to an example second embodiment of the present disclosure.

A second embodiment of the present disclosure has a basically similar configuration to the configuration of the first embodiment. Differences will be described with reference to FIG. 9. FIG. 9 is a conceptual perspective view of a toner conveying member according to the second embodiment of the present disclosure.

In the first embodiment illustrated in FIG. 1, the free lengths and L3) of the backup sheet 23*c* are continuously changed.

In the second embodiment, the free lengths (L1, L2, and L3) of the backup sheet 23*c* are discontinuously changed from L1 to L3, as illustrated in FIG. 9.

That is, it is only required that the free lengths L1, L2, and L3 do not decrease with an increasing distance from the position Y1 adjacent to the driving transmission member 17 toward the position Y3 and do not continuously change.

In other words, as illustrated in FIG. 9, the free lengths L1, L2, and L3 of the backup sheet 23*c* may be changed (increased) stepwise. Although the backup sheet 23*c* in FIG. 9 is shaped in three steps (that is, free lengths L1, L2, and L3, L1<L2<L3), the backup sheet 23*c* may be shaped in four steps. Also in the case of four steps or more, the free length of the backup sheet may be increased from the driving side to the non-driving side.

The present embodiment basically provides the same advantageous effects as the advantageous effects of the first embodiment.

Example Third Embodiment

Figure 10:
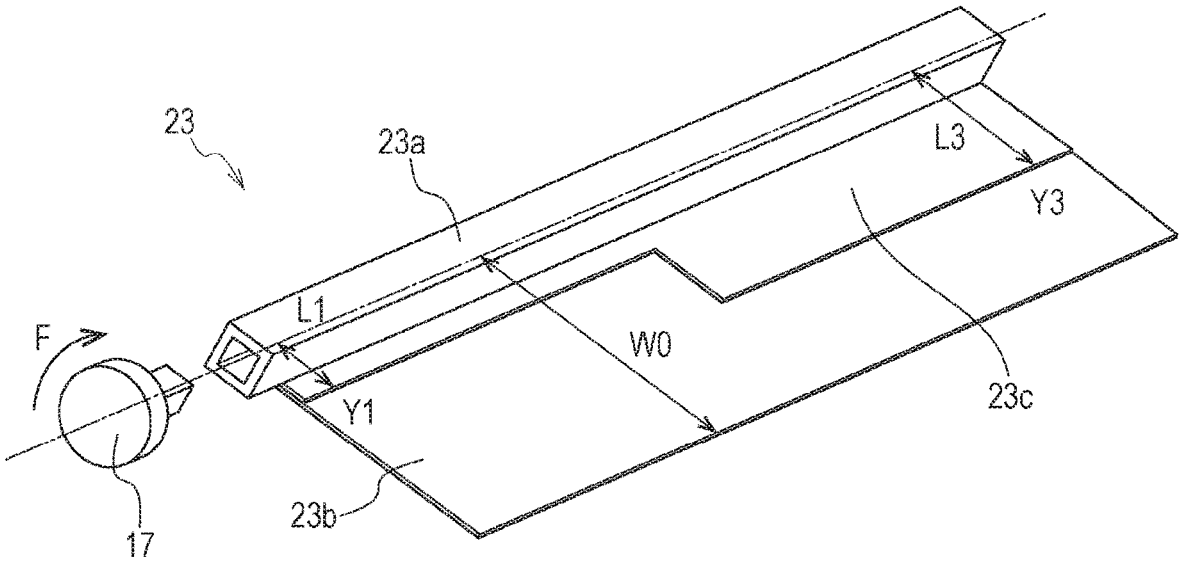
FIG. 10 is a conceptual perspective view of a toner stirring member in a process cartridge according to an example third embodiment of the present disclosure.

A third embodiment of the present disclosure has a basically similar configuration to the configurations of the second embodiment and the first embodiment. Differences will be described with reference to FIG. 10. FIG. 10 is a conceptual perspective view of a toner conveying member according to the third embodiment of the present disclosure.

As illustrated in FIG. 10, the free length of the backup sheet 23*c* in the present embodiment has "two steps" that satisfy L1<L3.

That is, the free length of the backup sheet 23*c* of the developing unit 4 may be larger at the farthest position (Y3) from the driving transmission member 17 in the axial direction of the rotation shaft 23*a* than at the nearest position (Y1) (L1<L3).

In other words, the lengths L1 and L3 may be in two steps, as illustrated in FIG. 10.

The present embodiment provides basically the same advantageous effects as the advantageous effects of the first embodiment.

The embodiments of the present disclosure allow the amount of toner conveyed from the developer container to the developing chamber to be more uniform in the longitudinal direction.

While the present disclosure has been described with reference to example embodiments, it is to be understood that the invention is not limited to the disclosed example embodiments. The scope of the following claims is to be accorded the broadest interpretation so as to encompass all such modifications and equivalent strictures and functions.

This application claims the benefit of Japanese Patent Application No. 2018-043243, filed Mar. 9, 2018, which is hereby incorporated by reference herein in its entirety.

What is claimed is:

1. A developing apparatus comprising:

a developer container configured to contain a developer;

a rotation shaft disposed in the developer container and rotatable along a predetermined rotational direction;

a driving transmission member connected to one end of the rotation shaft in an axial direction and configured to transmit an external driving force to the rotation shaft to rotate the rotation shaft;

a first conveying member mounted to the rotation shaft, with one end being fixed as a fixed end to the rotation shaft and another end being free as a free end in a direction perpendicular to the axial direction of the rotation shaft; and a second conveying member mounted to the rotation shaft, with one end being fixed as a fixed end to the rotation shaft and another end being free as a free end in the direction perpendicular to the axial direction of the rotation shaft, wherein a free length from the fixed end to the free end is smaller than that of the first conveying member, wherein, in a rotational direction of the rotation shaft, the second conveying member is disposed upstream of the first conveying member, with the fixed end of the second conveying member and the fixed end of the first conveying member placed one on another, and wherein the free length of the second conveying member at a first position, a second position, and a third position, which sequentially distance away from the driving transmission member in the axial direction of the rotation shaft, sequentially becomes larger.

2. The developing apparatus according to claim 1, wherein the free length of the second conveying member changes continuously in the axial direction of the rotation shaft.

3. The developing apparatus according to claim 2, wherein the free length of the second conveying member changes in an entire area of the rotation shaft in the axial direction.

4. The developing apparatus according to claim 1, wherein the free length of the second conveying member changes stepwise in the axial direction of the rotation shaft.

5. The developing apparatus according to claim 1, wherein the first conveying member and the second conveying member are elastic sheet-like members.

6. The developing apparatus according to claim 5, wherein the second conveying member is thicker than the first conveying member.

7. The developing apparatus according to claim 1, wherein the second conveying member has a bending elastic modulus higher than a bending elastic modulus of the first conveying member.

8. The developing apparatus according to claim 1, further comprising:

a developing unit disposed above the developer container and housing a developer carrying member carrying the developer; and an opening communicating the developer container and the developing unit with each other.

9. The developing apparatus according to claim 1, wherein the developing apparatus is detachably mounted to a main body of an image forming apparatus configured to form an image.

10. A developing apparatus comprising:

a developer container configured to contain a developer;

a rotation shaft disposed in the developer container and rotatable along a predetermined rotational direction;

a driving transmission member connected to one end of the rotation shaft in an axial direction and configured to transmit an external driving force to the rotation shaft to rotate the rotation shaft;

a first conveying member mounted to the rotation shaft, with one end being fixed to the rotation shaft as a fixed end and another end being free as a free end in a direction perpendicular to the axial direction of the rotation shaft; and a second conveying member mounted to the rotation shaft, with one end being fixed to the rotation shaft as a fixed end and another end being free as a free end in the direction perpendicular to the axial direction of the rotation shaft, wherein a free length from the fixed end to the free end is smaller than that of the first conveying member, wherein, in a rotational direction of the rotation shaft, the second conveying member is disposed upstream of the first conveying member, with the fixed end of the second conveying member and the fixed end of the first conveying member placed one on another, and wherein the free length of the second conveying member at a position farthest away from the driving transmission member in the axial direction of the rotation shaft, is larger than that at a position nearest to the driving transmission member.

11. The developing apparatus according to claim 10, wherein the free length of the second conveying member changes stepwise in the axial direction of the rotation shaft.

12. The developing apparatus according to claim 10, wherein the first conveying member and the second conveying member are elastic sheet-like members.

13. The developing apparatus according to claim 12, wherein the second conveying member is thicker than the first conveying member.

14. The developing apparatus according to claim 10, wherein the second conveying member has a bending elastic modulus higher than a bending elastic modulus of the first conveying member.

15. The developing apparatus according to claim 10, further comprising:

a developing unit disposed above the developer container and housing a developer carrying member carrying the developer; and an opening communicating the developer container and the developing unit with each other.

16. The developing apparatus according to claim 10, wherein the developing apparatus is detachably mounted to a main body of an image forming apparatus configured to form an image.

17. A process cartridge detachably mounted to a main body of an image forming apparatus configured to form an image, the process cartridge comprising:

a developing apparatus comprising:

a developer container configured to contain a developer;

a rotation shaft disposed in the developer container and rotatable along a predetermined rotational direction;

a driving transmission member connected to one end of the rotation shaft in an axial direction and configured to transmit an external driving force to the rotation shaft to rotate the rotation shaft;

a first conveying member mounted to the rotation shaft, with one end being fixed as a fixed end to the rotation shaft and another end being free as a free end in a direction perpendicular to the axial direction of the rotation shaft; and a second conveying member mounted to the rotation shaft, with one end being fixed as a fixed end to the rotation shaft and another end being free as a free end in the direction perpendicular to the axial direction of the rotation shaft, wherein a free length from the fixed end to the free end is smaller than that of the first conveying member, wherein, in a rotational direction of the rotation shaft, the second conveying member is disposed upstream of the first conveying member, with the fixed end of the second conveying member and the fixed end of the first conveying member placed one on another, and wherein the free length of the second conveying member at a first position, a second position, and a third position, which sequentially distance away from the driving transmission member in the axial direction of the rotation shaft, sequentially becomes larger; and an image carrying member configured to carry an electrostatic latent image, wherein the electrostatic latent image carried on the image carrying member is developed by the developing apparatus.

18. A process cartridge detachably mounted to a main body of an image forming apparatus configured to form an image, the process cartridge comprising:

a developing apparatus comprising:

a developer container configured to contain a developer;

a rotation shaft disposed in the developer container and rotatable along a predetermined rotational direction;

a driving transmission member connected to one end of the rotation shaft in an axial direction and configured to transmit an external driving force to the rotation shaft to rotate the rotation shaft;

a first conveying member mounted to the rotation shaft, with one end being fixed to the rotation shaft as a fixed end and another end being free as a free end in a direction perpendicular to the axial direction of the rotation shaft; and a second conveying member mounted to the rotation shaft, with one end being fixed to the rotation shaft as a fixed end and another end being free as a free end in the direction perpendicular to the axial direction of the rotation shaft, wherein a free length from the fixed end to the free end is smaller than that of the first conveying member, wherein, in a rotational direction of the rotation shaft, the second conveying member is disposed upstream of the first conveying member, with the fixed end of the second conveying member and the fixed end of the first conveying member placed one on another, and wherein the free length of the second conveying member at a position farthest away from the driving transmission member in the axial direction of the rotation shaft, is larger than that at a position nearest to the driving transmission member; and an image carrying member configured to carry an electrostatic latent image, wherein the electrostatic latent image carried on the image carrying member is developed by the developing apparatus.

* * * * *